United States Patent [19]

Klein

[11] 4,424,850

[45] Jan. 10, 1984

[54] SECURITY PROOF SHUTTER

[76] Inventor: Emil Klein, 103-25 - 68 Ave., Apt. 3H, Forest Hills, N.Y. 11375

[21] Appl. No.: 125,477

[22] Filed: Feb. 28, 1980

[51] Int. Cl.[3] ..... E06B 9/16; E06B 7/086; E05F 15/20

[52] U.S. Cl. ..... 160/133; 160/1; 160/5

[58] Field of Search ..... 160/32, 36, 133, 172, 160/229 R, 1, 2, 5, 242, 228, 229 B, 220

[56] References Cited

U.S. PATENT DOCUMENTS

| | | | |
|---|---|---|---|
| 1,595,234 | 8/1926 | Kuyper | 160/242 X |
| 1,646,432 | 10/1927 | Tomkinson | 160/211 |
| 2,819,628 | 1/1958 | Wardlaw | 160/133 |
| 2,820,516 | 1/1958 | Cookson, Jr. et al. | 160/209 |
| 2,836,238 | 5/1958 | Baldwin | 160/229 R |
| 2,921,628 | 1/1960 | Alvarez | 160/23 R |
| 3,646,985 | 3/1972 | Klann | 160/5 |
| 3,860,055 | 1/1975 | Wild | 160/5 |
| 3,915,377 | 10/1975 | Sutton, Jr. | 160/1 |
| 4,010,790 | 3/1977 | Varga | 160/220 |

FOREIGN PATENT DOCUMENTS

| | | | |
|---|---|---|---|
| 1516 | of 1871 | United Kingdom | 160/133 |
| 1168901 | 10/1969 | United Kingdom | 160/132 |
| 1288072 | 9/1972 | United Kingdom | 160/1 R |

*Primary Examiner*—Peter M. Caun
*Assistant Examiner*—Cherney S. Lieberman
*Attorney, Agent, or Firm*—Gottlieb, Rackman & Reisman

[57] ABSTRACT

Security proof shutter structure applicable to windows, doors, store or garage fronts, utilizing slats constructed of steel or the like. A special S-shaped spring linkage means is secured to respective ends of the slats. The lower hook of each linkage means being engaged with the upper hook of the adjacent linkage means to provide a rotatively operative linkage between adjacent slats without fixed attachment.

The hooked linkage is well adapted to independently install or remove any one slat on site and to independently control by sliding the closing of the louvre spacing between adjacent slats or moving apart from each other. The louvre spacing between adjacent slats can be progressively closed or opened. The full lowering takes place with opened louvre spacing and by continued lowering the progressive closing of the louvre spacing between adjacent slats will take place. The winding around the upper roller takes place with fully opened louvre spacing. The series of slats are supported by sliding on opposite ends within vertical U-shaped channels.

A special locking device provides two stopping means disposed on the periphery of the pulley and a flexible control rod operating by sliding between the two stopping means. The operator can actuate the control rod to enter into or withdraw from the space between the two stopping means, whereby the shutter can be locked at any position or louvre spacing so that it provides ventilation or communication and full protection.

17 Claims, 16 Drawing Figures

FIG. 5
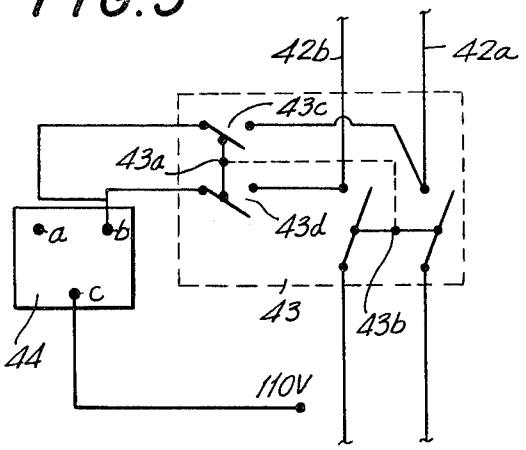
FIG. 7
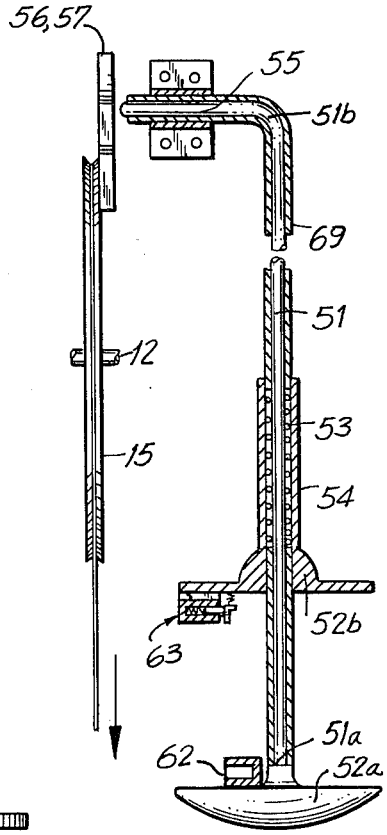
FIG. 6
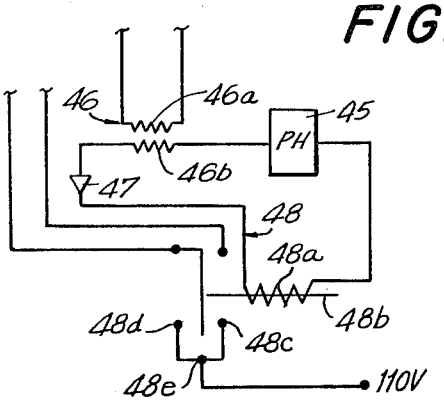
FIG. 7A
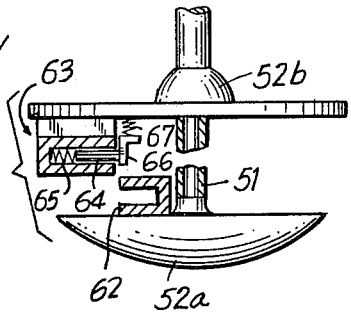
FIG. 7B
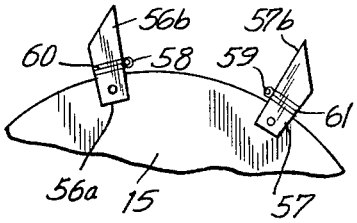
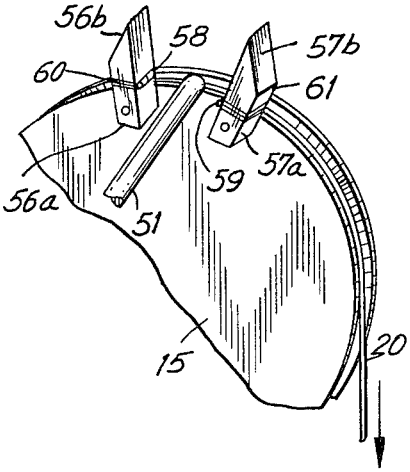
FIG. 7C FIG. 8
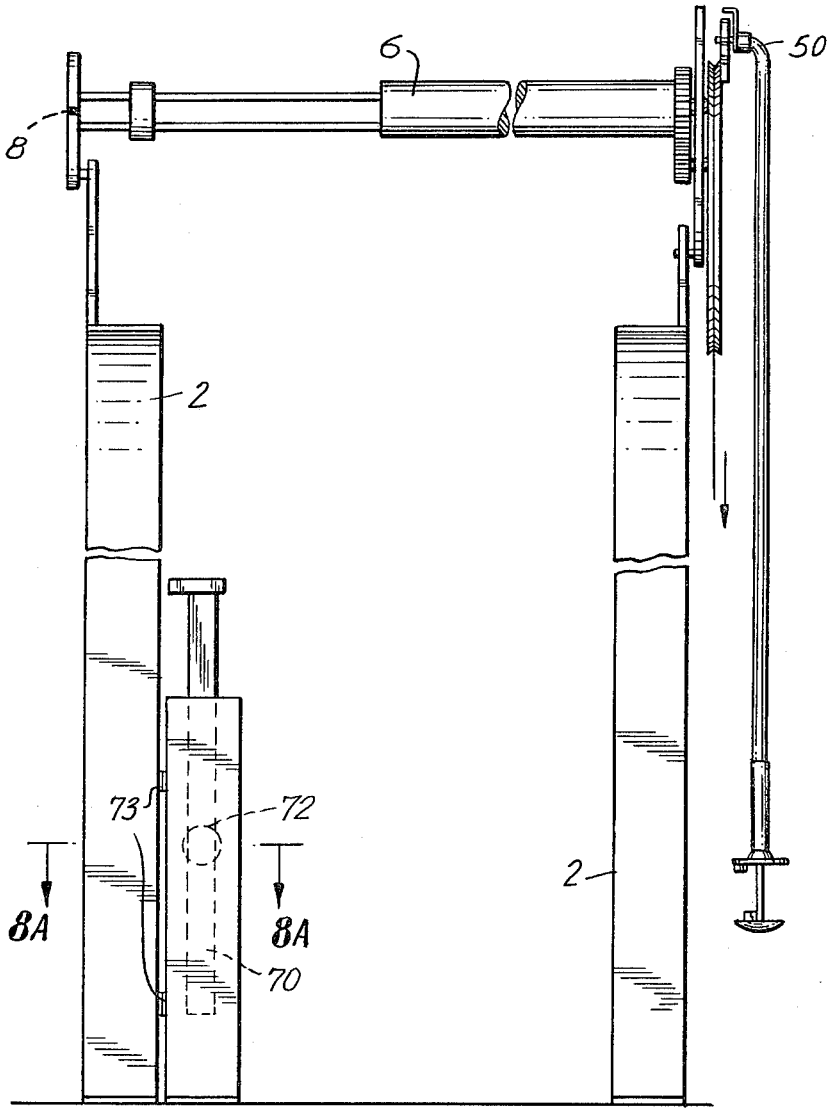
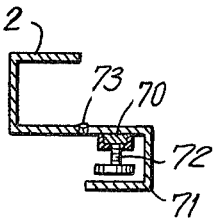
FIG. 8A

SECURITY PROOF SHUTTER

SECURITY PROOF SHUTTER

This invention relates to a specific security proof shutter device providing an intercombination of various structural features to be applied particularly to windows, doors, store or garage fronts, etc. As per its basic characteristics it constitutes full protection against burglary or breaking through by having the slats constructed of heavy material, steel, or the like and it serves as a variable shading device against sun light due to its variable louvre opening feature. In addition the slats may be constructed from a combination of steel and heat insulating material to save energy. Also it can be safely locked at any position or louvre spacing of the slats so that it provides the desired ventilation or communication and still provides protection.

All venetian blinds or other commercially available shading devices in the prior art are relatively of light weight material and collected in a stack on the top when fully raised. The slats are tied together by some sort of textile band to constitute one piece of structure and so they are not suitable to serve as protection against burglary or fire.

This invention, however, relates to a security shutter having all slats of heavy material such as steel or the like. An S-shaped spring linkage means is fixedly secured to each slat to serve as a pivotal link connection between slats, permitting asemblage of the shutter slat by slat at the site of installation. The slats are independently secured for sliding within a U-shaped channel.

The slats are spaced apart an amount substantially equal to the width thereof by a plurality of spring linkage means forming a link between the adjacent slats from fully closed to fully opened position in order to provide full coverage of the window or door frame space. By the application of U-shaped channels mounted on each side of the opening allows the sliding of the slats from fully closed to fully opened position.

The top operating mechanism comprises a cylinder with a head structure including the driving pulley and gear transmission to easily operate the slats for raising, lowering or setting to any variable spacing despite a the heavy steel structure. Note that the slats start to open at first from the top and progressively open downwardly to allow ventilation or free communication on the top and at the same time it provides full protection against breaking through due to its heavy or steel structure. Note that the head structure has a provision for adjustability to suit any opening or installation conditions on the wall.

Thus it represents a simple and low cost solid steel or similar type of structure of high quality, durability and architectural beauty. Due to the adjustable nature of the head structure, it is adaptable to any existing structural condition. Therefore the shutter can be installed on the inside wall, into the wall space or on the outside wall. The prefabricated parts are prepared to any desired dimension allowing an easy installation by any customer without mechanical skill by merely using a screw driver in securing it around the wall opening.

Accordingly one of the main objects of this invention is to provide a shutter structure having all slats of steel or other heavy material and full protective character against any breaking through and still supplying the desired ventilation or free communication from inside to the outside.

Another important object of the invention is to provide a specially shaped spring linkage means secured on each end of each slat allowing the linking the adjacent slats in an operative manner but without fixed attachment to permit an installation of the shutter slat by slat. Also by the actuation of the rope around the pulley on the rotating cylinder will cause the opening of the louvre spacing between slats to take place by starting from the top slat and progressively continuing to open downwardly to the lower slats.

A further object of the invention is to provide U-shaped vertical channels on both ends of the shutter to operatively engage the series of spring linkages to allow the sliding movement of all slats and thereby to make possible the operation of the shutter structure for raising, lowering or setting to any desired position of the louvre spacing of the series of slats.

Another object of the invention is to provide a rolling cylinder and head structure carrying the combination of pulley and gear mechanism with cordlike push-pull rope to be adjustable for usage on any plain wall structure.

A still another object of the invention is to provide the cylinder head structure with an electric motor and speed reduction gear mechanism connected to a power source to allow the operation of the shutter from any remote point by means of a connecting conduit-cable controlling the starting or stopping the motor at any desired position.

A still further object of the invention is to provide a shutter structure having the slats constructed of a combined steelheat-insulating material to operate as a heat energy conserving device controlling the heat out-flow through the windows by setting the position of the slats in response to a heat sensitive thermostat connected to a motor power circuit.

A still another object of the invention is to provide a shutter structure to operate as a variable shading device controlling the amount of sunlight passing through the opened position of the slats in response to a light sensitive element connected to the motor circuit to start or stop the motor in response to the light sensitive device.

A further object of the invention is to provide a special locking device of simple construction for safely locking the shutter at any position (lowered or raised) or under any opened spacing of the slats. This lock is not key operated, therefore it complies with Code and Fire Department regulations.

Further objects of the invention lie in the combination of the various above mentioned arrangements to form a complete combination shutter, shading and energy saving device and also include the various subcombinations of the elements and their interrelation.

The objects of the invention will become more evident from the detailed description presented in conjunction with the accompanying drawings and for better understanding reference will be made to them in which:

FIG. 1 represents a front view of the complete shutter structure mounted on the wall of the window frame having the driving cylinder-head assembly on the top and indicating the upper half of the slats in fully opened position and the lower half in fully closed position.

FIG. 1*a* represents a vertical sectional view taken along the U-shaped channel at one end of the shutter structure indicating the series of spring linkage means secured to the respective ends of the slats in fully closed position.

FIG. 1*b* is a similar sectional view to that shown on FIG. 1*a* indicating the slats in fully opened position.

FIG. 1*c* is a vertical cross-sectional view of one of the spring linkage members of FIGS. 1*a* and 1*b*.

Figure 4:
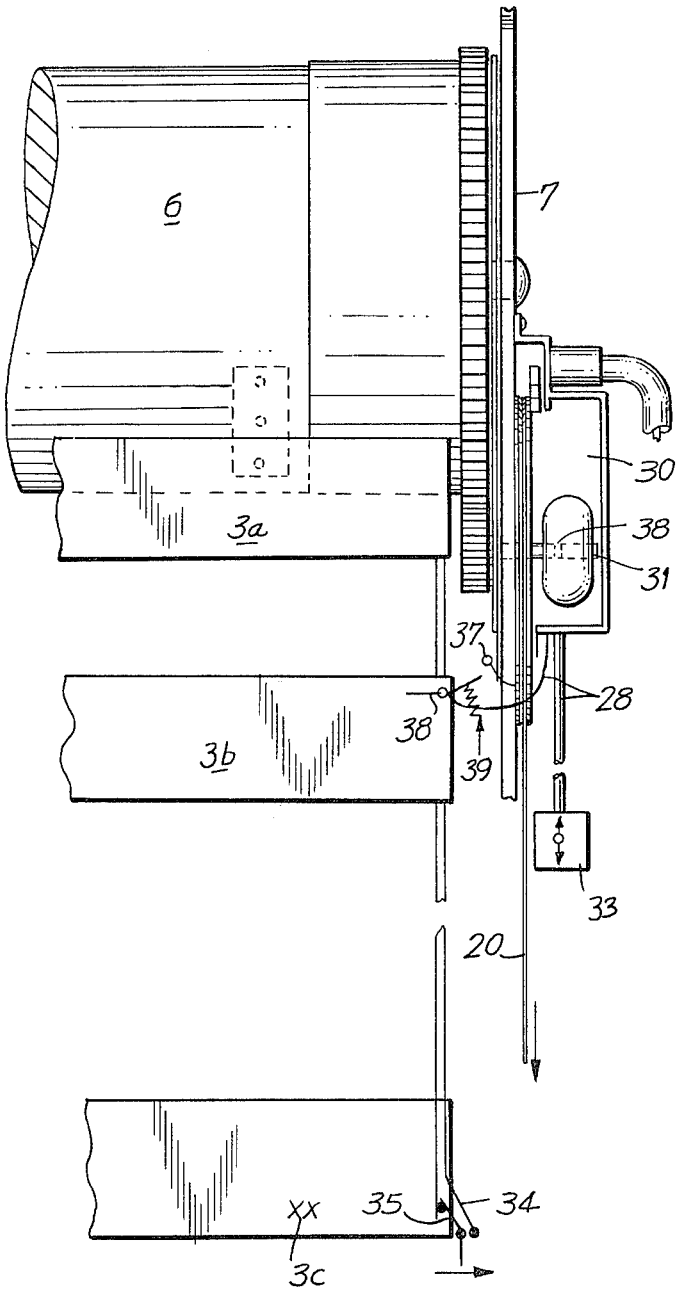
FIG. 4 represents the front view of the electric motor and gear transmission assembly mounted on the head driving structure for operating the shutter.
Figure 4A:
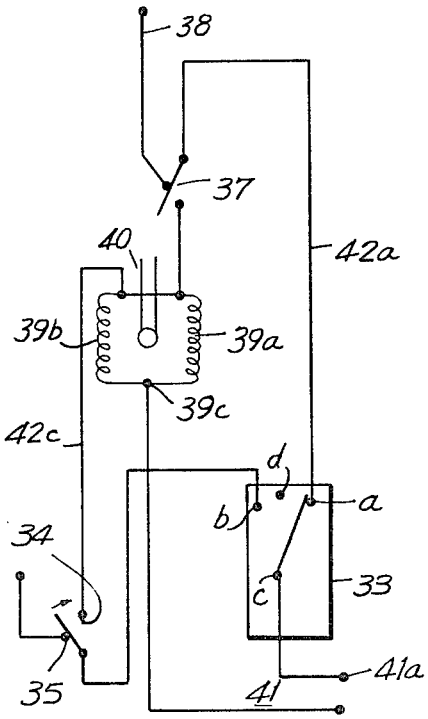

FIG. 4*a* is a diagrammatic illustration of the motor circuit controlled by limit switches and single pole double throw switch unit.

FIG. 5 is a diagrammatic illustration of the motor circuit controlled by a thermostat or heat sensitive element.

FIG. 6 is a diagrammatic illustration of the motor circuit controlled by a light sensitive element or photocell.

FIG. 7 represents the front view of the complete novel locking device.

FIG. 7*a*, represent detailed fragmentary view of the control knob of the locking device.

FIG. 7*b* is a fragmentary view of stopping members on the rope pulley

FIG. 7*c* represents a detailed front view of the control rod of the locking device.

FIG. 8 represents a front view of an alternate embodiment to control the closing of the slats at variable positions, FIG. 8A is a horizontal cross-sectional view taken substantially along the line 8a—8a of FIG. 8.

Similar component parts in the various figures are designated by similar reference characters.

Figure 1:
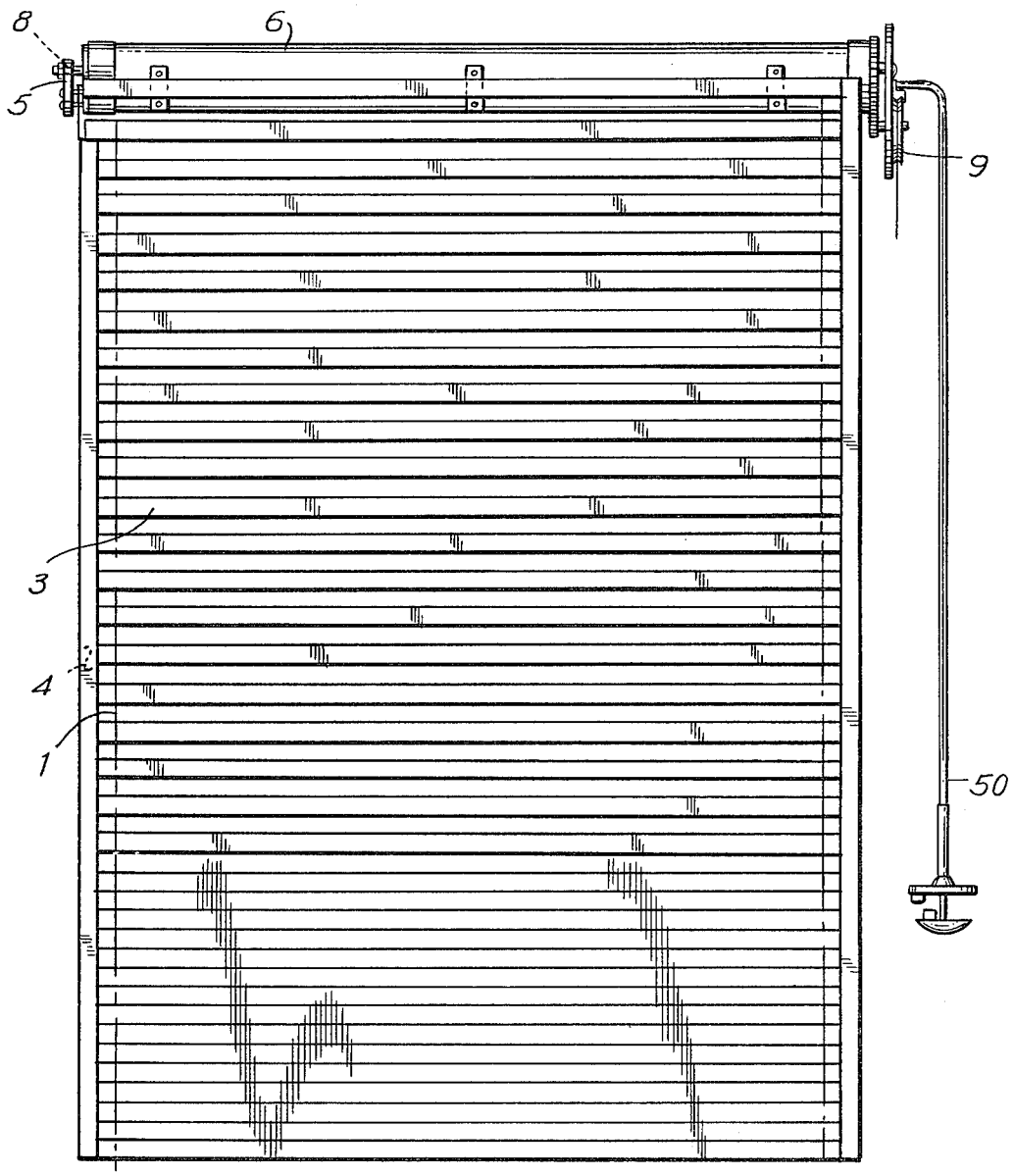

Referring more particularly to FIG. 1 there is illustrated a front view of the complete shutter structure mounted on the inside wall surface around the recessed window frame to provide a security proof shutter system in accordance with the invention. Note that the upper half of the slats are indicated in fully opened position and the lower half in fully closed position. In FIG. 1 the reference character 1 denotes the border line of the full wall opening having the recessed window frame installed therein which is not shown here. It is to be understood that the shutter structure can similarly be installed on the exterior wall surface behind the window and to be operated from inside.

One U-shaped vertical channel denoted by the reference numeral 2 is mounted on the wall at both ends of the shutter structure to serve to guide the slats denoted by the reference numeral 3 for vertically sliding movement and to hold them against transverse movement. Furthermore specially shaped spring linkage means denoted by the reference numeral 4 are secured to each end of each slat to constitute a pivotally engageable or disengagable link or interlock between adjacent slats without fixed attachement and are similarly shaped for vertical sliding movement within the U-channel 2.

The complete upper head assembly generally indicated at 5 being mounted on the upper end of the U-channel and on any inside surface near the top of the shutter structure. It comprises a rotating cylinder 6 with an adjustable head structure 7 on one side and on the opposite side being journalled in bearing 8. The head structure 7 is provided with means for fixedly mounting the complete head assembly. The head assembly 5 incorporates all operating components for tilting the head structure 7 and to actuate the raising or lowering the series of slats by either manual or motor operated means and also it carries the driving mechanism generally indicated at 9, and the locking device generally indicated at 50.

It is to be noted that the special characteristics of the shutter structure lies in the fact that by the application of the specially shaped spring linkage means between adjacent slats, each slat moves independently and leaving behind a louvre space until the full opening between all the slats have been completed. Note that the winding up the series of slats on the rotating cylinder takes place in the noted fully opened position between the slats. The uppermost slat 3*a* is fixedly secured to the rotating cylinder 6 in order to hold it against vertical movement shown on FIG. 4. The details of all elements of the shutter structure will be described in the subsequent figures for a better understanding of the system operation.

Figure 1A:
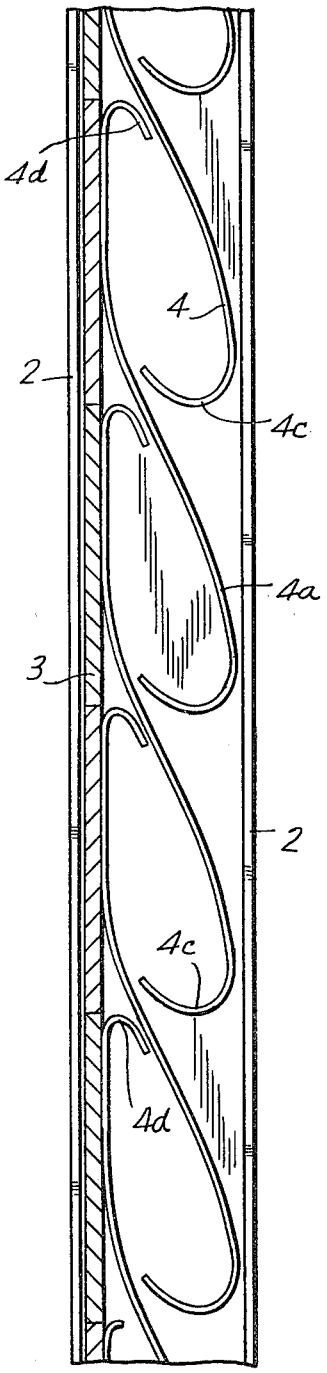

In FIG. 1*a* the vertical section along the U-shaped channel 2 indicates the specially shaped spring means 4 being secured by welding to both ends of the respective slats 3 in fully closed position. In this illustration the spring linkage means 4 has the double length of the slat width so that its upper half 4*a* is secured by riveting, spot welding or the like to the slat 3, whereas its lower half 4*b* serves as a hook to limit the sliding movement of the adjacent slat regarding the length of opening of the louvre spacing which occurs at the time when the end 4*c* of the lower hook of the spring linkage 4 engages the end 4*d* of the upper hook of the adjacent spring linkage. In this manner the actual opened louvre spacing between adjacent slats is limited to the possible maximum displacement of the slat 3. This condition is shown on FIG. 1*b*.

In accordance with the invention the sliding operation of the series of slats within the U-shaped vertical channel is secured against any transverse movement. In fact the S-shaped spring hook sliding in the guided U-channel in such that no play exists between them, whereby the absolute vertical alignment of the series of slats in closed or extended position is fully secured. Also the action of the heavy weight of the slats largely contributes to the achievement of the noted operation. The opening between slats commencing from the top and follows downwardly in a progressive succession. The importance lies in the fact that the slats being opened at first on the top provides ventilation or free communication and still provides full security against burglary.

Due to the fact that there is no fixed attachement between adjacent slats, as they are merely linked together by a hook, the lower hook of each linkage means being engaged with the upper hook of the adjacent linkage means to provide a rotatively operative hooked linkage between adjacent slats without fixed attachement. Thus the shape of the hooked linkage is well adapted to independently install or remove anyone slat on the site and to independently actuate by sliding the closing or opening the louvre spacing between adjacent slats. It follows that the basic structural feature of the invention makes possible the installation of the shutter slat by slat so that it allows the usage of slats constructed of steel or other heavy material providing a full security proof shutter system.

Figure 1B:
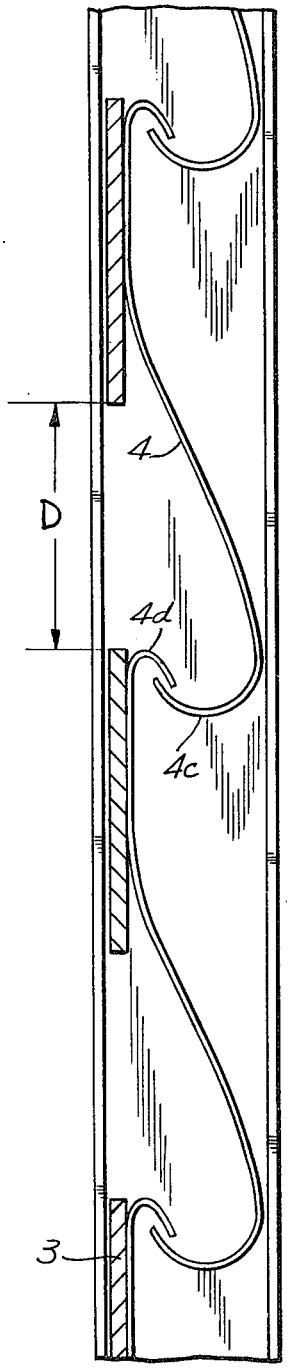
Figure 1C:
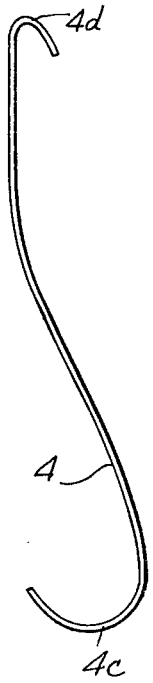

FIG. 1*b* represents the vertical section along the U-shaped channel 2 indicating the spring linkage means 4 secured by welding to both ends of the respective slats 3 in fully opened position. It indicates that the end 4*c* of the lower hook of the spring linkage 4 engages the end 4*d* of the upper hook of the adjacent spring linkage, and are operatively engaged with each other. It is understood that the lower portion 4*b* of the spring linkage means 4 can be shorter or longer, whereby the opening space D between adjacent slats can accordingly be narrower or wider to meet the customers desire. Since all operating components are identical otherwise with that indicated on FIG. 1*a*, no further details are given.

Figure 2:
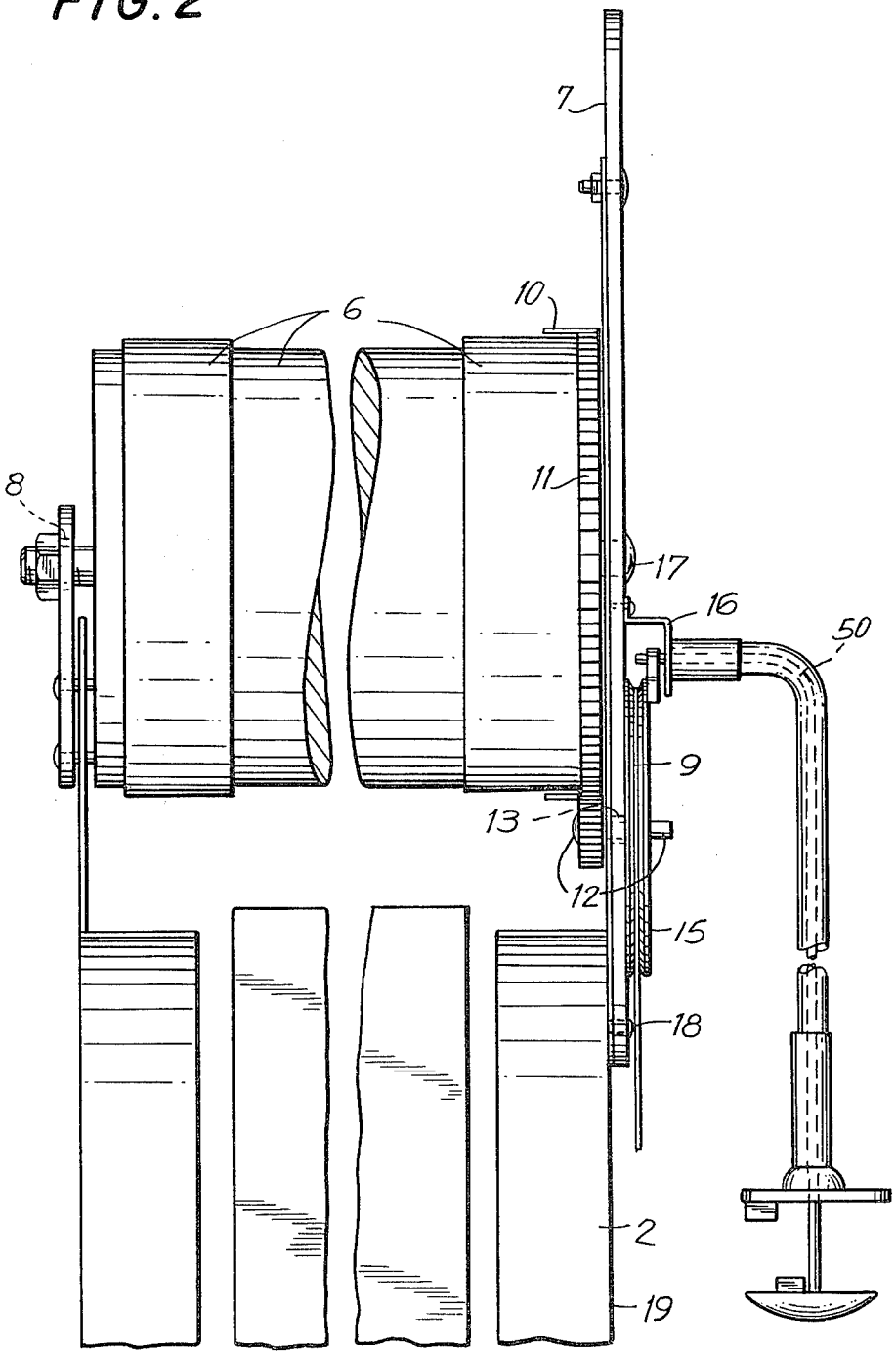
FIG. 2 represents a detailed front view of the complete rotating head-assembly taken along the length of the structure indicating the rotating cylinder, head plate, the rotating shaft affixed thereto carrying the pulley with cordlike rope and the gear mechanism.

FIG. 2 represents the front view of the complete head assembly generally indicated at 5. It comprises a rotating cyclinder 6 with an adjustable head structure 7 on one side and on the opposite side being journalled in bearing 8. It incorporates all operating components for actuating the series of slats in accordance with the invention.

The cylinder 6 is closed at each end by a steel cover plate 10 and 10A, respectively, which carries on the driving side the complete driving mechanism comprising a wheel-gear 11 fixedly attached to the cover plate 10 for rotation therewith. A separate shaft-member 12 is disposed and journalled in bearing 13 to carry the pinion 14 and pulley 15. The component parts 12,13,14 are directly intercombined with the head plate 7 and supported thereby. The firm position of the bearing 13 is reinforced by means of a holding arm 16 in order to secure the exact relationship between the wheel-gear and pinion for safe operation. The pulley 15 is driven manually by a push-pull rope 20 to turn the gear 11 and to drive the slats 3. Note that the first slat 3*a*, shown on FIG. 4, is attached to the cylinder 6.

The cover plate 10 having at its center a shaft member 17 affixed to head plate 7 for free rotation in the center circular opening of the head structure 7. The bottom of the head structure 7 being pivotally supported by a shaft member 18 mounted on the extension backside 19 of the U-channel 2 so that the head is pivotally connected thereto to constitute an adjustable attachement. However, the top of the head structure 7 is mounted on the further extension backside of the U-channel, the details of which will be described hereinafter in subsequent FIG. 3. The left side plate 10A is identical with the driving side plate 10, except without any parts of the driving mechanism.

A push-pull rope element 20 being looped around the pulley 15 for driving it manually in a conventional manner well known in the art. The groove of the rope pulley 15 is being shaped, rough or the like in order to provide a gripping effect upon the push-pull rope. Accordingly the manual driving mechanism provides a substantial speed reduction so that the pinion and/or pulley must make a large number of revolutions to effect one revolution of the gear-wheel or cylinder. In this application it has the main purpose to allow an easy operation of the slat movements despite their heavy weight.

The operation of raising, lowering or opening, closing of the shutter is as follows:

a. Raising process for winding-up the slats.

With initially fully closed position of all slats covering the entire window space, the raising procedure takes place by progressive separation of the slats starting from top to bottom with louvre opening between adjacent slats determined by the length of the hooked-linkage. The first slat is firmly attached to the surface of the rotating cylinder-roller, therefore the first separation takes place between the first and closest adjacent slat.

Figure 3:
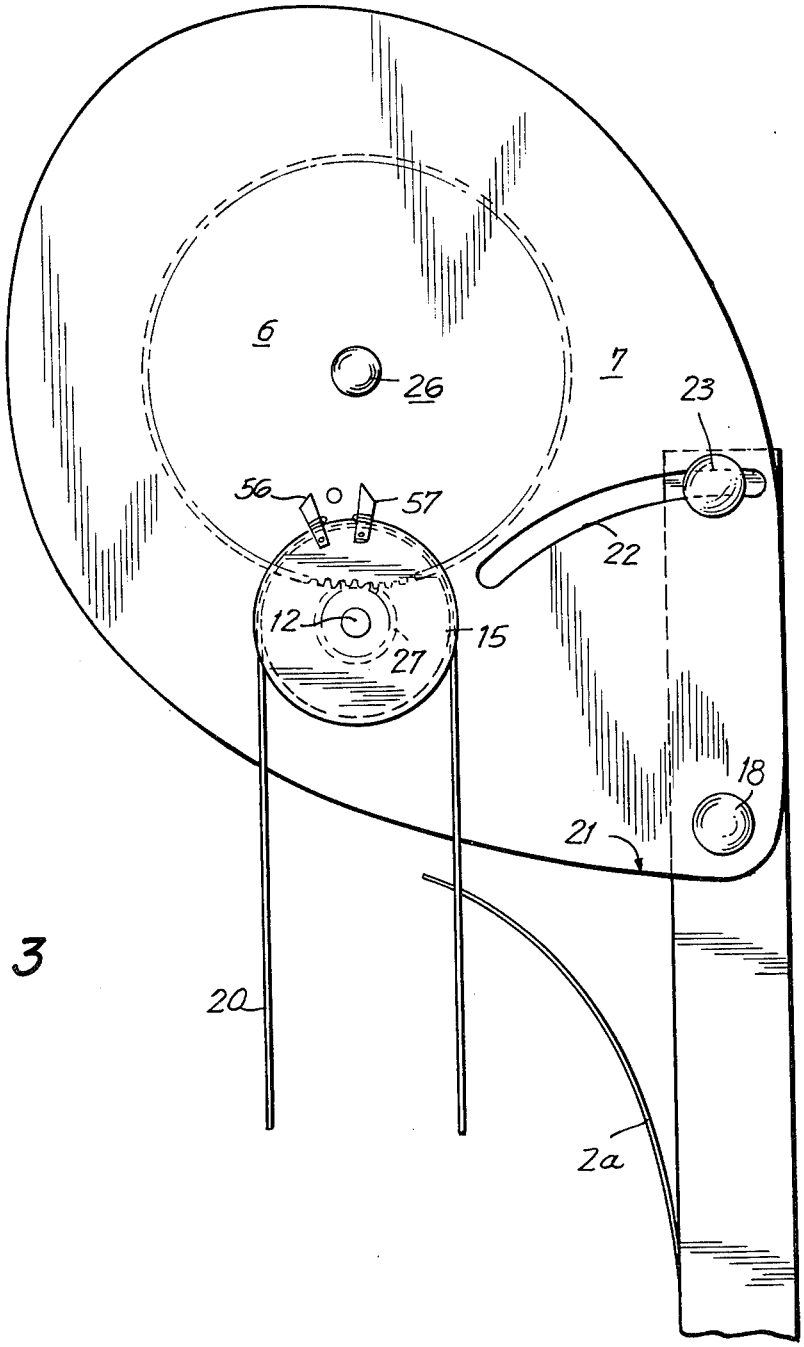
FIG. 3 represents the side view of the head-assembly indicating the push-pull cordlike rope looped around the pulley and adjustability of the head structure.

At the starting of the winding process the actual separation proceeds in a progressive manner, approximately three slats with a separation corresponding to the predetermined louvre spacing will constitute the first layer encircling the roller surface as indicated on FIG. 3 where the slats 3 are shown with full lines and the spring hooks 4 are shown with dotted lines. The first slat 3*a* is firmly attached to the cylinder surface by means of a flexible link 3*aa*.

As the process continues, the slats will actually at first carry their firmly attached hooks entirely free of mutual engagement. It is the only way to build the louvre spacing between the adjacent slats in accordance with the principles of the invention that the firmly attached hooks must come into close mutual engagement with the hooks of the adjacent slats. In fact, the hooks are firmly attached and closely guided in vertical alignment within the inside of the U-channel. It follows that after a predetermined or limited free run, the hooks must come into mutual engagement with the hooks of the adjacent slats in a successive manner and such that this operating performance repeatedly takes place until such time that the last hook of the series of slats becomes also engaged.

In the meantime the forwarding slats continue to wind-up around the cylinder-roller. However, after a given point to be called the second stage of raising procedure, the complete opening is covered with slats of opened louvre spacing, whereby the remaining slats will be hanging on their hooks. Thus this completely opened louvre surface may permit to let in full daylight and still provide full protection for the people inside by means of the power of the slats constituting a strong steel grate.

Upon further rotation of the cylinder-roller, the noted grate becomes progressively lifted by the continued winding-up the slats to form successive layers of larger diameter and more slats per layer. This process lasts until all the opening becomes fully clear from any slat or grate. Note that the winding-up process is greatly facilitated by the thin hooked spring linkages between slats.

As a conclusion of the winding-up process, the limit stop shown in FIG. 4 disposed on the closest slat to the lowermost slat-which is now in its highest position- will prevent any possible overrunning beyond permissible limit positions, whereby the winding process is terminated with the largest diameter. In order to accommodate the woundup roller in the available space above the opening, provision is made for pivotal adjustment of its angular position so that it extends along the ceiling as may be required for any particular job installation. The limit switch assembly on the top is, therefore, located corresponding to the largest diameter of the cylinder-roller for correct switching contact operation. (see limit switch on FIG. 4)

b. Lowering process for closing the opening.

Upon further rotation of the cylinder-roller in the reversed direction, the lowering process from the initial fully opened position takes place by progressive dropping down the series of slats with fully opened louvre spacing until the lowermost slat reaches the bottom of the shutter opening structure so that the complete opening is closed by the louvred grate. Note that the downward running is also facilitated by the weight of the slats.

Upon continued lowering of the series of slats, the louvre spacing starting to close from the lowest portion and becomes progressively closed from bottom to top until all the opening surface is closed by the series of slats. Note that for the full closing in accordance with the principles at this invention, the spring hooks will evidently accommodate themselves by assuming their positions within each other as required for full closure and shown on FIG. 1A. Note that the limit switch assembly is also disposed on the top but located corresponding to the smallest diameter of the cylinder-roller for correct switching contact operation. Accordingly, the limit stop is located on the slat closest to the uppermost slat to prevent any possible overrunning beyond permissible limits. It is evident that the shutter can be stopped at any desired opened or closed position as described under FIG. 8.

FIG. 3 represents a side view of the complete head structure 7 having its lower protruding end 21 supported by a shaft number 18 fixedly mounted on the extension back-side 19 of the U-channel 2, whereby the head is connected thereto by pivotal means to constitute an adjustable attachment.

The head 7 is also provided with an arcuate slot 22 having fixedly mounted therein a screw 23 for the purpose to adjust the desired angular position of the head structure in a secured manner to accommodate the existing mounting conditions on the wall in order to make possible the operation in the selected plane inside, outside or in the window opening. Furthermore the top of the head 7 is permanently mounted to the top of the back-side extension 19 of the channel incorporating therein the adjusting screw 23 for permanent adjustment to be required by the mounting conditions on the site. As indicated, on side of the U-channel 2 at the top 2*a* being bent outwardly to the extent as to allow an easy entering of the series of slats into the U-channel.

The importance of the flexibility of the described specific installation method of the shutter provides a smooth transition movement of the slats into and out of the channel when rolling up or down around the cylinder and irrespective of whether the centerline of the rotating cylinder is assymetrically displaced with any desired angle.

At the center of the head 7 there is provided a circular space or bearing 26 to allow the cylinder 6 indicated by dashed lines for free rotation therein. Also the head 7 indicates bearing 27 to allow the shaft member 12 to extend therethrough its free end carrying the pulley 15 outside of the head. The pulley also carries the cube-members 56, 57 of the locking device.

The push-pull rope element 20 is looped around the pulley 15 for driving it manually in a conventional manner well known in the art. The groove of the rope pulley 15 is corrugated or shaped so as to provide a gripping effect upon the push-pull rope 20. It is to be noted that the uppermost slat is fixedly attached to the rotating cylinder 6 and the adjacent slat is shown to approach the entry into the U-channel by a smooth transition movement. For a clearer presentation, this condition is indicated by dashed lines on FIG. 2. The two dashed lines represent a cutout section of the middle part of the cylinder 6. Furthermore it means that the middle piece together with the two end pieces shall correspond to the actual width of the window space. The uppermost slat is denoted by 3*a* and the adjacent slat by 3*b* shown on FIG. 4.

It is important to note that the spring linkage preferably shall be fabricated of very thin spring steel and the slats of flat cold rolled steel. Since the spring linkage has the characteristics of springing back to the former shape after having completed its rotative movement around the roller, therefore the winding-up process is greatly facilitated. By intercombining the very thin spring linkage with heavy steel-slats, the shutter system allows a very easy operation and provides full security in every respect.

FIG. 4 represents a front view of the combination gear-pulley transmission unit and shutter to be operated by an electric motor. The motor unit generally indicated at 29 includes its own gear transmission, not shown here, which forms an integral part of the motor unit to reduce the speed of rotation of the pulley shaft. The motor unit is enclosed into a casing 30 which is mounted to the head assembly and the output shaft 31 of the motor unit is connected by a coupling 32 to the shaft-member 12 of the pulley 15 for rotation therewith. Since otherwise the operation of the shutter is similar to that described in connection with the pulley-drive, no further details are given.

A single pole double-throw switch assembly denoted by the reference numeral 33 is mounted on the wall or at any convenient remote location and wired to the motor. The wiring 28 may be run along the U-channel for convenience. In order to prevent the motor from continued running after the raising or lowering procedure is completed, there are limiting switches provided to cut-off the motor operation at such limiting positions.

The first limit switch assembly controlling the stoppage of the shutter at the completion of the raising process, comprises a fixed contact 34 and pivotal contact-arm 35 being supported by a spring 36 to hold it in a closed position with the fixed contact 34. A stopping means 35*a* is disposed on the slat 3*c* being closest to the lowermost slat. The first switch assembly is mounted on the top at the head structure 7 in a position corresponding to the large diameter of the finally wounded cylinder-roller 6. Thus it is so located that when the slat 3*c* reaches its highest position-, identical to the position shown for slat 3*b*,—the stopping element 35*a* exerts an abutment on the pivotal lever contact-arm 35, whereby causing the contacts to open and stop the motor as required to prevent further raising beyond permissible limits.

The second switch assembly comprises a fixed contact 37 and a pivotal lever contact-arm 38 being supported by a spring 39 to hold it in closed position with the fixed contact 37. Also a stopping means 38*a* is disposed on the slat 3*b*. Note that the first slat 3*a* is attached to the roller 6 and the closest adjacent slat 3*b* is shown to be separated by a louvre spacing. Thus when slat 3*b* reaches the uppermost position, it exerts abutment on the pivotal lever contact-arm 38 causing to open against the spring force and to stop the motor to prevent further lowering beyond permissible limits.

The wiring methods and detailed operation of the motor circuit to be described hereinafter in the following FIG. 4*a*.

FIG. 4*a* is a diagrammatic illustration of the motor circuit indicating a preferred embodiment using a single pole double-throw switch 33 noted on FIG. 4. The applied motor can preferably be a reversible type, although any other type of motor may be used in conjunction with a special switching device to reverse the power flow into the motor windings as required.

In this diagram the indicated preferred type motor is the split capacitor structure having two identical windings 39*a*, 39*b*, connected between the capacitor 40 having the capability of reversing the motor rotation by actuating the single pole double throw switch 33 from one position 33*a* to the other 33*b* as shown. The hot leg 41*a* of the power input source 41 being connected to the center point 33*c* of the SPDT switch, the switching action of which may establish the alternate connection of the hot leg to either of the contacts 33*a*,33*b*, respectively. The other common terminal 39*c* of the motor windings 39*a*,39*b*, is connected to the neutral point of the power source 41.

Furthermore the fixed contact 37 of the first limit switch assembly is connected to one terminal of the motor winding 39*a* and its movable lever contact 38 is connected by wire 42*a* to the terminal 33*a* of the SPDT switch. Similarly the fixed contact 34 of the second limit switch assembly is connected to one terminal of the motor winding 39*b* by wire 42*c* and its movable lever contact 35 is connected by wire 42*b* to the terminal 33*b* of the SPDT switch. It is noted that the limit switches are in series with the motor windings controlling the cut-off of the motor operation.

We assume that initially the switching arm of the SPDT switch is in the center position 33*d* representing the open motor circuit irrespective of whether one or both limit switches are in closed condition, However, if the contact arm of the SPDT switch is on the 33*a* or 33*b* position, a closed operating circuit is being established between the power input source and the motor through either of the limit switches. Accordingly we may determine three different initial starting conditions for the motor as follows:

a. The shutter is in fully closed position and so the contact-arm limit switch 35 is opened. Consequently, the contact-arm limit switch 38 is closed and by setting the SPDT switch on the 33*a* position, the motor circuit becomes closed through the winding 39*a* to operate the motor in the raising direction.

b. The shutter is in fully opened position and so the contact-arm limit switch 38 is opened. Consequently, the contact-arm limit switch 35 is closed and by setting the SPDT switch in the 33*b* position, the motor circuit becomes closed through the winding 39*b* to operate the motor in the lowering direction.

c. The shutter is in any middle position and so both limit switches are closed. Consequently, by setting the SPDT switch selectively on the 33*a* or 33*b* position, the motor will operate correspondingly in the selected direction for raising or lowering direction as required.

It is quite clear that the switching action of either of the limit switches may open or close the motor circuit. It is to be noted that the occurrence of the switching actions of the limit switches shall be adjusted by the proper setting of the pivotal lever contact-arm such that the stoppage of the motor operation shall take place just before the utmost extreme position of the shutter is reached in order to prevent a reversed rotation of the shutter should an overrunning occur in either directions.

FIG. 5 is a diagrammatic illustration of a modified control circuit of the invention for automatic operation of the motor in response of a heat sensitive device or thermostat to be connected in series with the motor circuit.

In this figure similar compenent elements are denoted by like reference characters indicated in FIG. 4, The basic circuit arrangement in this figure is mainly identical to that shown on FIG. 4, therefore such identical parts will not be described.

The main switching mechanism comprises preferably a selector switch assembly denoted by the reference numeral 43 consisting of a double pole double throw switch with switch elements 43*a*, 43*b*, allowing the switching over the motor circuit from manual to automatic operation. The upper switch element 43*a* serves to close the automatic circuit operation, while the lower switch element 43*b* serves to close the manual circuit operation.

The automatic control circuit further comprises preferably a thermostatic element denoted by the reference numeral 44 of the single pole-double-throw type for direct power line operation. The left contact 44*a* serves the hi-limit line 42*a* and the right contact 44*b* serves the lo-limit line 42*b*. The 110 volt power source is connected to the common central leg 44*c* of the thermostatic element 44. In this manner the SPDT switching type thermostatic element constitutes a full substitution for the SPDT switch assembly 33 to re-establish the same operation of the reversible motor as required for the hi, lo-limit or neutral position is response of the variable outside weather conditions. It is quite evident that due to the inherent interlocking structure of the double-pole, double throw selector switch assembly 43, if the upper switch element 43*a* closes the thermostatic lines for the contacts 44*a*, 44*b*, the wiring leads 43*c*, 43*d*, becomes connected to the manual lines 42*a*, 42*b*, respectively, to establish the automatic operation, whereas the lower switch element 43*b* remains opened and the manual operation becomes interrupted. If the setting of the selector switch is in the lower position, the inverse process takes place, thereby it is prevented that both manual or automatic position can be operative at the same time.

It is to be noted that the automatic operation has the purpose of controlling the in-flow or out-flow of heat through window space. Therefore the slats shall preferably be constructed from a combination of steel and insulating or heat-resistive material in order to fully prevent the heat flow through the window space when the slats of the shutter are fully closed. Since the major heat loss takes place through the window, this automatic control method provides a substantial energy saving.

FIG. 6 is a diagrammatic illustration of of another modified control circuit for automatic operation of the motor in response to a light sensitive photocell element. The main distinguishing feature of this control method lies in the fact that the photocell element must be operated by low voltage and DC current. Accordingly this arrangement comprises a photocell element denoted by the reference numeral 45, a low voltage transformer unit 46 with the primary high voltage winding 46*a*, a secondary low voltage winding 46*b*, a rectifier element 47 and a relay coil assembly 48 having a relay coil 48*a*, a contact arm 48*b* disposed by sliding between contact pairs 48*c*, 48*d*, having one contact of each connected to a common terminal 48*e* carrying the 110 volt of the power source 41. In this set-up the relay-contact arrangement operates as a single pole double throw switch as required.

The terminals of the primary winding 46*a* is connected to another tap on the power source. not shown here, and the secondary winding 46*b* being connected in series with the photocell element 45, rectifier 47 and the relay coil 48*a*. The extent of the energization intensity of the relay coil is controlled by the variation of the photocell resistance element which, in turn, will control the current flowing through the relay coil. It follows that the extent of displacement of the contact arm 48*b* will close either 48*c* or 48*d* contact pair in response to of the photocell resistance changes reflecting the variation of the outside sunlight conditions. Accordingly it functions as a single pole double throw switch arrangement. It is noted that the indicated control represents a two-position method, however, it can be extended to a continuously variable control not shown here. The variable control shall operate in an identical manner as described in the connection with the thermostatic control indicated on FIG. 5, so no further details are given. Otherwise the control circuit operates similar to the previous control circuit configuration.

FIG. 7 represents the front view of the complete special locking device forming an integral part of the shutter structure to provide a full security proof shutter in every respect. The basic operating component element is the flexible control rod denoted by the reference numeral 51 extending from the control point up to the pulley. The upper end of the control rod 51 is bent 90 degrees at the point 51*b* to assume an exact 90 degrees position to the surface of the pulley 15 and located in the free space above its periphery. The supporting element 55 is mounted on the head structure 7 and disposed to serve for the encircling of the control rod 51 as required for its sliding movement into the space above the pulley to perform the locking as described hereinafter.

This FIG. 7 indicates that a lower knob-head 52*a* is secured to the lower end 51*a* of the control rod 51, whereas the upper knob-head 52*b* being disposed at a given distance provided with a center hole to allow a free passage therethrough for the control rod. Upon pushing the lower knob-head 52*a* in the forward direction towards knob-head 52*b*, it will cause the forward sliding of the flexible control rod 51 into the space above the pulley 15, whereby any further rotation of the pulley will be impeded. For this purpose locking or stopping means are provided on the periphery of the pulley to effect its full stoppage irrespective of whether the pulley's actual rotation is in clockwise or counter-clockwise direction.

The actual locking operation can be best understood by the inspection of the diagram 7*c*. There are two identical stopping cube-members 56,57, being fixedly mounted on the periphery of the pulley 15 for rotation therewith. Each of the cube-members are constructed of two parts, the lower parts 56*a*,57*a*, respectively are pivotally secured to their upper parts 56*b*57*b*, by means of hinge elements 58,59.

The hinges are so constructed that the upper parts 56*b*,57*b*, can decline from normal upright to horizontal direction into the inside direction only (towards center). Note also that the hinge elements 58,59 are controlled by springs 60,61, disposed thereon to allow the upper parts 56*b*,57*b*, to return from horizontal to normal upright position after abutment has taken place between the control rod and the cube-members. When the control rod 51 enters the space above the periphery of the pulley rotating in any direction, an abutment between the control rod and cube-members will occur. Should this abutment come from the outside of the cube-members, then the upper part will decline and let the control rod to enter into the inside space between the cube-members. Thus the control rod will move until it will hit the upper part of the second cube-member which will effectively stop any further movement and will remain there until such time that it will be withdrawn by the operator.

For a better understanding we shall assume two different positions that the control rod may enter the space above the pulley:

A-position: Control rod enters the space above the pulley when the cube-member is at its left or right side. Under this condition, the pulley rotates until the control rod hits the incoming cube-member, which then becomes forced to decline into the inside horizontal position, whereby the control rod enters into the space and remains caught in the inside between the two cube-members.

B-position: If accidentally the control rod enters the center space between the two cube-members, it will remain caught in this position because the upper part of the cube-members cannot decline to the outside.

FIG. 7 also indicates that a spring element 53 being disposed around the control rod 51 to be attached thereto at a point 51*c* above the upper control knob-head 52*b*. A metal tube element 54 is disposed around the spring 53 and is firmly secured to the upper knob-head 52*b*. The upper part of the spring element 53 is firmly secured to the top of the tube 54. Upon pushing the lower knob-head 52*a* in the forward direction until it reaches the upper knob-head 52*b*, it will exert a contracting force or pressure upon the spring element 53 and will generate a spring force in the reversed direction urging to push back the control rod in the normal position which, however, is prevented by the locking effect provided in the control knob unit to be described hereinafter.

The locking together of the knob-heads 52*a*,52*b*, in the controlled opened position is accomplished by the application of U-shaped steel member 62 disposed at the lower knob-head 52*a* and another U-shaped steel member 63 disposed at the upper knob-head 52*b*. The steel member 63 is additionally provided with an inside slidable square shaped rod element 64 being permanently supported by a spring element 65 urging said rod member 64 to move out from its steady position in the U-shaped space. However, such spring action being withheld by an angle iron piece 66 disposed thereon which is permanently supported by a spring element 67, thereby to constitute an obstruction for the free displacement of the square rod 64.

Upon closing the knob-heads together, the abutment of the U-shaped member 62 with the angle iron piece 66 against the force of the spring 67, releases the urging force of the spring 65 causing the square shaped rod 64 to move out from the U-member 63 and to slide into the U-shaped steel element 62 in order to provide the locking in this position. This action, in turn, forces the control rod 51 to remain in the locked position between cube-members 56,57.

In order to release the locking effect upon the cube-members on the pulley, the control rod must be withdrawn from the inner space between both cube-members on the pulley. For this purpose the control knob shall be released by actuating the release button 68 being adapted to move back the square rod 64 into the U-shaped space of the steel member 63 against the force of the spring 65. Consequently the square rod 64 will be held again in its former space by the angle iron piece 66 supported by the spring 67 in its permanent position. In this manner, the control knob 52*a* becomes free to be withdrawn into the original lower position. Thus the control rod 51 withdraws from the inner space between the two cube-members 56,57, whereby the pulley 15 becomes released for the resumption of continued rotation and the control knob unit is again ready for the next operation to lock the shutter.

It is noted that the control rod 51 is enclosed within a flexible tube 69 for free movement therein.

FIG. 8 represents another embodiment of the invention with the provision to control the closing of the louvre spacing between adjacent slats under any position of the series of slats within the window space occupied by the shutter structure.

According to the normal operation of the shutter structure, at first the slats must be lowered to the bottom of the window space and only thereafter will follow the progressive closure of the louvre spacing between adjacent slats by further pulling the rope down until the slats are completely accumulated at the bottom when the full closure of the louvre spacing between slats is accomplished.

It is to be noted that oftentimes it is desirable to drop down the shutter to any selected position in order to prevent the sun shining through the upper part of the window space which is usual the case, whereas the lower part of the window being left fully open to let in ample ventilation.

For this purpose there is provided a blocking unit comprising two U-shaped steel members 70 and 71 of given length being disposed for sliding movement within each other. On the interior steel member 70 there is provided a thread-screw 72 serving to adjust the distance between the interior and exterior members to be explained hereinafter. The exterior steel member 71 is constructed to exactly fit into the U-channel 2. A hinge element 73 being provided to pivotally interconnect the exterior U-shaped steel member with the U-channel.

Under normal operation when the slats may be lowered to the bottom of the shutter, the exterior member 71 is being held initially at its extreme outward position by means of the hinge element 73 so that the slats may freely be lowered to any position.

If it is desired to block the lowering of the slats at any intermediate position along the U-channel 2, the exterior U-shaped steel member 71 including the interior member 70 shall be rotated by means of the hinge 73 to its extreme inward position to be within the U-channel. It follows that the interior U-shaped steel member 70 can by sliding be displaced at any position and secured in place by the adjustment of the screw 72 tightening the interior steel member to the exterior steel member.

Consequently at any adjusted position, the top of the interior U-shaped steel member 70 provides a blocking effect for further downward movement of the slats to allow the full closure up to this point.

In order to remove the obstruction or blocking effect, the inverse process shall take place by rotating the blocking unit back to the extreme outward position by means of the hinge 73.

While in the foregoing there has been shown and described some of the preferred embodiments of this invention, it will, of course, be understood that various details of construction, combinations and intercombinations of various elements or components and arrangements of parts may be resorted to without departing from the principles of the invention including the spirit and scope, it is, therefore, not the purpose to limit the patent granted thereon otherwise than necessitated by the scope of the appended claims.

What I claim as new and desire to secure by Letters Patent of the United States is:

1. A security proof shutter structure comprising a plurality of slats, a plurality of linkage means, a left and right hand vertical channel means, an upper rolling means, a pulling means; the upper part of each of said linkage means firmly secured to respective ends of said slats, the upper and lower end of each of said linkage means formed as an S-shaped spring hook, said lower hook of each of said linkage means being engaged with said upper hook of the adjacent linkage means to provide a hooked linkage of rotative operation between said adjacent slats without fixed attachement, the shape of said hooked linkage adapted to independently install or remove anyone slat on shutter site and to independently actuate by sliding the progressive closing or opening of the louvre spacing up to anyone pair of adjacent slats, said slats are supported by sliding on opposite ends within said respective vertical channels, said pulling means adapted to actuate the sliding of said plurality of slats downwardly or upwardly within said vertical channel means and to actuate the winding of said slats around said upper rolling means.

2. The structure as defined in claim 1 wherein the selected length between ends of the upper and lower hook portion of said linkage means determining the maximum louvre spacing between said adjacent slats.

3. The structure as defined in claim 1 wherein said slats being constructed of flat steel.

4. The structure as defined in claim 1 wherein said linkage means being constructed of thin spring material to facilitate the rotation of said linked slats around said rolling means and to allow an installation or removal slat by slat by engaging or disengaging said lower hook with said upper hook.

5. The structure as defined in claim 1 wherein by lowering said series of slats, the opening of louvre spacing between said adjacent slats starting from top followed by progressive opening to bottom and by further lowering said series of slats the louvre spacing becomes progressively closed from bottom to top.

6. The structure as defined in claim 1 wherein at initial fully closed position the raising of the slats takes place by progressive opening of the louvre spacing between adjacent slats starting from bottom to top and the winding around said upper rolling means takes place by fully opened louvre spacing between said adjacent slats to form closed layers.

7. The structure as defined in claim 1 wherein said channel means being constructed from U-shaped steel.

8. The structure as defined in claim 1 wherein said upper rolling means comprising a rotating cylinder for rolling-up said series of slats, a head structure with a bearing to allow said cyclinder for free rotation therewith, said head structure supported by a shaft member mounted by pivotal means on the extension of said right hand channel for permanent adjustment to any angular position with respect to the entry to said U-channel means for smooth transition of said series of slats from said rotating cylinder into said U-channel means.

9. The structure as defined in claim 1 wherein the left hand side of said rotating cylinder being mounted by pivotal means on the extension of said left hand U-channel for permanent adjustment to any angular position.

10. The structure as defined in claim 1 wherein said upper rolling means comprises a driving mechanism including a pulley with push-pull rope and speed reduction gear assembly, said driving mechanism further comprising a source of electric power, a reversible motor for driving said series of slats upwardly or downwardly, a power switching means forming a power circuit to said motor and being adapted to connect said power source by manual switching for operating said motor in either directions, a first and second limit switching means in series with said power circuit for controlling the vertical movement of said series of slats between the upper and lower extreme positions; said first limit switching means having a contact-arm disposed thereon in operative connection with the closest to uppermost slat when fully lowered and second limit switching means having a contact-arm disposed thereon in operative connection with the closest to lowermost slat when fully raised, whereby said first and second limit switching means being actuated when said slats reaching their respective lowest or highest extreme positions for stopping said motor for further operation to prevent overrunning beyond maximum or minimum limits, said both limit switching means mounted on top at corresponding positions related to the wounded or unwounded rolling means.

11. The structure as defined in claim 10 wherein said motor power circuit further comprising a heat sensitive control element being connected in series with said motor power circuit; a selector switching means for voluntary setting said motor power circuit to either manual or automatic operation being operatively connected thereto, said control element responsive to variations of outside weather conditions operating as a single pole double throw control device to actuate the automatic operation of the closing or opening of the shutter accordingly when said selector switching means being set for automatic operation, said heat sensitive control element having a resistance varying in proportion of the temperature changes and being adapted to continuously control by sliding the progressive opening or closing of the louvre spaces between adjacent slats followed by progressive opening or closing the shutter space.

12. The structure as defined in claim 10 wherein said motor power circuit further comprising a sunlight sensitive element, a low voltage transformer, a rectifier element, a relay assembly having a coil with single pole double throw contact-arm, said sunlight sensitive element connected in series with said rectifier into the secondary circuit of said transformer, the rate of energization of said relay coil follows the resistance variation of said light sensitive control element being responsive to variation of sunlight intensity to actuate the automatic operation of the closing and opening of the shutter accordingly when said selector switching means being set for automatic operation, said sunlight sensitive element being adapted to continuously control by sliding the progressive opening or closing of the louvre spaces between adjacent slats followed by the progressive closing or opening of the shutter space.

13. The structure as defined in claim 1 further comprises a locking means having a control rod means operatively connected with a stopping means fixedly disposed on the pulley of said pulling means, said control rod means consisting of a flexible steel wire supported by sliding on said shutter structure, said stopping means consisting of two identical cube-members, each of said cube-members constructed of a lower part firmly attached to said pulley means and pivotally secured to its upper part by a hinge element being controlled by a spring element, upon actuating the displacement of said control rod an abutment with said cube-member takes place to effect the decline of the upper part of said cube-member from upright to horizontal position towards the inside center causing the entrance of said control rod into the center space between said cube-members to be followed by the return of said upper part to upright position, whereby said control rod caught between said cube-members causing a locking effect for further rotation of said pulley means.

14. The structure as defined in claim 13 further comprises a knob control unit consisting of an upper and lower knob-heads, said lower knob-head connected to lower end of said control rod and having a first U-shaped steel member firmly secured, said upper knob-head having a second U-shaped steel member firmly secured and provided with a slidable square shaped rod element supported by a first spring element being withheld from displacement by an angle iron piece element supported by a second spring element, upon closing said both knob-heads together the caused abutment of said first U-shaped steel member with said angle iron piece releases the urging force of said first spring element to cause said square shaped rod element to slide into said first U-shaped steel element providing a locking effect, a release button being disposed on said upper knob-head to actuate the return of said square shaped rod into said second U-shaped steel member, whereby to allow said lower knob-head to be withdrawn into its original lower position and to cause the withdrawal of said control rod from said stopping cube-members above the space of said pulley means to release said locking effect.

15. The structure as defined in claim 14 further comprises a third spring element disposed around said control rod attached thereto, a metal tube element disposed around said third spring element being attached to the top of said metal tube element, upon closing said both knob-heads together a force being generated in said third spring element, the release action of said third spring element urges the return of said lower knob-head to its original position causing the withdrawal of said control rod to release said locking effect.

16. The structure as defined in claim 1 further comprises a blocking unit consisting of an exterior and interior U-shaped steel member adapted for sliding movement within each other; said interior member being provided with a screw element for adjusting the distance between said steel members, a hinge element being provided for pivotally interconnecting said exterior member with said U-channel, said interior member being displaceable by sliding to any position within said U-channel to provide a blocking effect for the dowward movement of said series of slats.

17. The structure as defined in claim 1 wherein said slats being constructed of a combination of steel and heat insulating material for energy conservation.

* * * * *